US005988682A

United States Patent [19]

Alléra

[11] Patent Number: 5,988,682

[45] Date of Patent: Nov. 23, 1999

[54] COVERING DEVICE FOR ROLLER SKATES

[76] Inventor: Dirk Alléra, Kniprodestrasse 31, DE - 51067 Köln, Germany

[21] Appl. No.: 08/883,954

[22] Filed: Jun. 27, 1997

[30] Foreign Application Priority Data

Jun. 27, 1996 [DE] Germany ..... 296 11 226 U

[51] Int. Cl.[6] ..... A63C 3/00

[52] U.S. Cl. ..... 280/825; 280/11.22

[58] Field of Search ..... 280/825, 811, 280/11.22, 11.23; 36/132, 136; D21/226

[56] References Cited

U.S. PATENT DOCUMENTS

| | | | |
|---|---|---|---|
| 2,395,394 | 2/1946 | Carlson . | |
| 4,364,187 | 12/1982 | Melendez . | |
| 4,413,842 | 11/1983 | Loredo . | |
| 5,290,065 | 3/1994 | Kassal | 280/825 |
| 5,522,621 | 6/1996 | Schneider | 280/825 |
| 5,573,275 | 11/1996 | Smith et al. | 280/825 |
| 5,580,094 | 12/1996 | Ruehlman et al. . | |
| 5,697,643 | 12/1997 | Marasco et al. | 280/825 |
| 5,765,870 | 6/1998 | Riley | 280/825 |
| 5,833,270 | 11/1998 | Hubshman | 280/825 |
| 5,848,808 | 12/1998 | Fenton | 280/825 |

FOREIGN PATENT DOCUMENTS

| | | |
|---|---|---|
| 3016602 | 11/1981 | Germany . |
| 2961591 | 1/1997 | Germany . |

*Primary Examiner*—Richard M. Camby
*Attorney, Agent, or Firm*—Robert W. Becker & Associates

[57] ABSTRACT

A covering device for rollers of roller skates includes a cover element for positioning underneath rollers of a roller skate. A fastening element is connected to the cover element for fastening the cover element to the roller skate. The cover element includes a ground contact surface extending, when the covering device is attached to the roller skate, in a direction of travel of the rollers of the roller skates. It has an arc shape in the direction of travel to allow an ergonomic foot movement of the user of the roller skate.

35 Claims, 12 Drawing Sheets

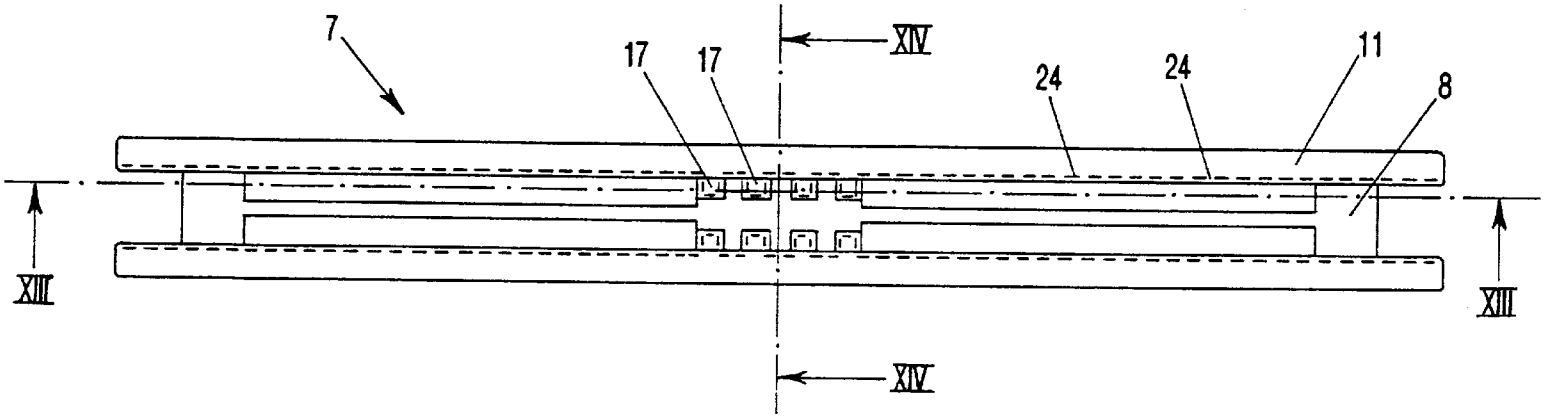
FIG-12
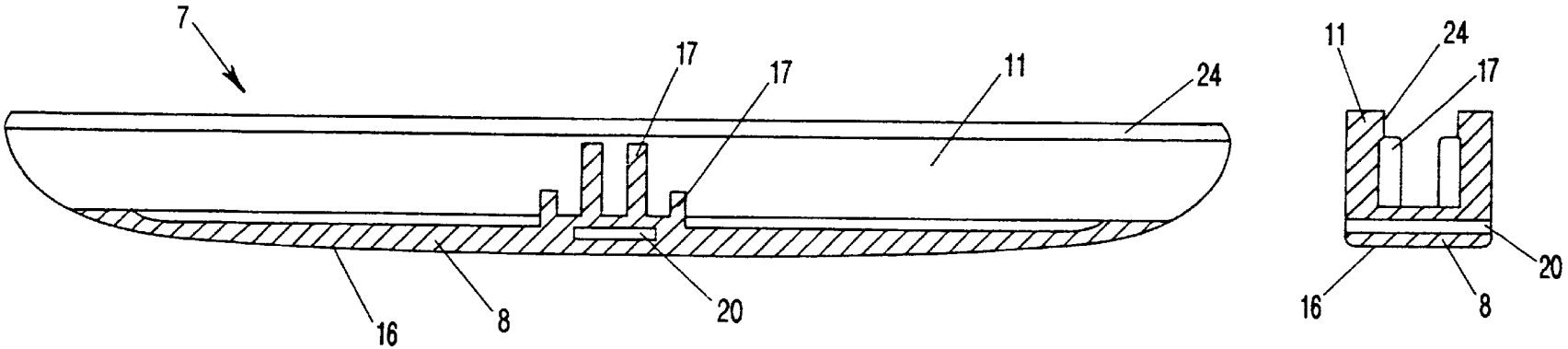
FIG-13
FIG-14

COVERING DEVICE FOR ROLLER SKATES

BACKGROUND OF THE INVENTION

The present invention relates to a covering device for the rollers of roller skates, especially inline skates comprised of at least one covering element with at least one fastening element to be positioned underneath the rollers.

Different types of roller skates are known for sporting and hobby activities, for example, so-called roller skates, inline skates etc., which differ with respect to their design and arrangement of the rollers. In the context of the present invention the term roller skates is meant to include all types of skates provided with rollers. When putting such roller skates on, they allow driving on suitable surfaces. When encountering unsuitable surfaces, for example, gravel, sand, or cobblestone, driving is no longer possible or possible only with difficulty. Furthermore, such surfaces can result in damage to the roller skates. Furthermore, the use of such roller skates is prohibited in many areas, for example, in parks, malls, and within buildings such as supermarkets, businesses etc. especially because of liability reasons. The user of such roller skates is thus limited with respect to the locations where such roller skates can be used and is thus forced to take along a pair of regular shoes.

In order to make possible the use of roller skates also on unsuitable surfaces and in areas where the use of roller skates is prohibited, German Patent Application 30 16 602 suggests a cover for locking the rollers of roller skate which in the mounted state prevent rotation of the rollers. This cover is substantially plate-shaped and is detachably connectable by clamping to the running surface of the roller skates. The cover forms between the rollers a substantially planar and rigid support surface. A safe and unimpeded walking movement is thus impossible with such a cover, especially since a rolling movement of the foot from heel to toe as performed when walking is prevented.

It is therefore an object of the present invention to provide a covering device for the rollers of roller skates, with which the limitations with regard to freedom of movement and moveability are reduced and with which the usefulness of such roller skates is broadened whereby at the same time an unimpeded and joint-protecting walking movement with the roller skates is possible.

SUMMARY OF THE INVENTION

The covering device for rollers of roller skates according to the present invention is primarily characterized by:

- a cover element for positioning underneath rollers of a roller skate;
- a fastening element connected to the cover element for fastening the cover element to the roller skate;
- the cover element comprising a ground contact surface extending, when the covering device is attached to the roller skate, in a direction of travel of the rollers of the roller skate and having an arc shape in the direction of travel to allow an ergonomic foot movement of the user.

Preferably, the arc shape is adjustable.

The cover element is preferably elastically deformable.

The cover element is preferably rail-shaped.

The ground contact surface has at least partly non-slip properties.

At least portions of the ground contact surface have a coating. The coating is preferably exchangeable.

Preferably, the cover element has a tread pattern.

The cover element is preferably rubberized.

The fastening element clamps the cover element to the roller skate. The fastening element preferably clamps onto the rollers. The roller skate has a securing element for the rollers and the fastening element preferably clamps onto the securing element.

The roller skate comprises a boot and the fastening element advantageously clamps onto the boot.

The fastening element is preferably a clamping bar.

The clamping bar in a preferred embodiment is a hollow bar having a C-shaped or U-shaped cross-section.

The fastening element preferably has spaced apart, opposed sidewalls extending parallel to the direction of travel and converging in an upward direction toward one another to allow a clamping action between the opposed sidewalls.

The fastening element is variably fastenable.

The rollers are positive-lockingly received in the covering device.

Advantageously, the cover element and the fastening element form a unitary part.

The covering device is preferably elastic. The covering device is preferably comprised of an elastic, resilient material.

Preferably, the covering device is comprised of plastic material.

The covering device in another embodiment of the present invention comprises at least one elastic, shape-stabilizing insert. The insert is preferably comprised of spring steel.

The covering device may be retrofitted to the roller skate.

The covering device may be embodied as a part of the roller skate.

The fastening element is preferably a strap that is elastic. The strap has a first and a second end. Preferably the strap has a VELCRO (hook and loop fastener closure.

Advantageously, the fastening element comprises an opening provided in the covering device.

The cover element has inner sides facing the rollers and the inner sides have positioning and fixation elements.

The positioning and fixation elements and the strap are located centrally at the covering device.

Two of the covering devices are preferably connectable.

The covering device may further comprise at least one non-slip insert that is preferably exchangeable.

According to the present invention, a covering device for the rollers of roller skates, especially inline skates, is comprised of at least one cover element positioned under the rollers and provided with at least one fastening element whereby the cover element when positioned under the rollers, has a substantially arc-shaped ground contact surface extending in the direction of travel of the rollers. The ground contact surface allows for an ergonomic movement of the foot when walking.

The ergonomic movement of the foot for walking in the context of the present invention refers to the movements dictated by the human support and movement apparatus, i.e., the human anatomy. In the present case it refers especially to the joint-protecting and fatigue-reducing rolling of the foot.

The inventive covering device can be positioned when needed under the rollers of a corresponding roller skate (inline skate) such that the cover element is positioned between the running surfaces of the rollers and the ground. It is important that a direct contact of the rollers with the ground is prevented.

With such a covering device positioned at a roller skate (inline skate) a normal forward movement, i.e., a normal walking or running, is possible as with a conventional shoe. It is thus possible to walk across unsuitable surfaces such as mud, gravel, sand, cobblestone, stairs etc. in a simple and effortless manner without changing shoes.

Entering and walking in buildings in which the use of roller skates (inline skates) is prohibited because of increased risk for injuries, is in principle now possible with the inventive covering device.

Furthermore, it is no longer necessary to carry along a pair of conventional shoes and the cumbersome transport of roller skates is no longer necessary. Furthermore, due to the covering device positioned under the rollers, especially when crossing unsuitable surfaces, the rollers of the roller skates are protected against wear and damage.

The inventive covering device provides a cover element designed for a particular type of roller skates and provides suitable fastening elements for the respective roller skate. Due to inventive shape of the ground contact surface, the rolling of the foot during walking is facilitated when using the correspondingly designed covering device of the invention. Furthermore, the arc shape of the ground contact surface of the cover element provides for a slightly resilient (spring) action which especially for walking results in a damping effect so that a joint-protecting walking is possible.

The covering device may be provided with a ground contact surface provided with a permanent arc shape relative to the surface to be walked on or may be provided with a ground contact surface that will receive its arc shape only after positioning of the covering device on the roller skate. For this purpose, the covering device may, for example, be elastically deformable and tensionable. Also, the covering device can be foldable and can assume the required inventive ground contact surface upon unfolding of the device.

According to a further advantageous embodiment of the invention, the arc shape of the ground contact surface of the cover element is adjustable, preferably variably adjustable. The ground contact surface can thus be adjusted to individual requirements with respect to the walking movement. For example, the degree of curvature of the arc can be varied and different arc shapes, for example convex or concave can be combined.

According to a further especially advantageous embodiment of the invention, at least the cover element of the covering device is elastically deformable. This provides a further spring action and damping so that a joint-protecting and substantially fatigue-free walking is possible.

Advantageously, the cover element is rail-shaped so that with a correspondingly positioned cover element a direct contact between the running surfaces of the rollers and the ground is prevented. The rail is advantageously matched to the rollers of the roller skate, respectively their running surface area. This means, that for example, for a roller skate in which the rollers are arranged sequentially in the travel direction, the cover element in the form of a rail extends substantially straight in the direction of travel of the rollers.

According to a further advantageous embodiment of the invention the ground contact surface of the cover element is at least partly embodied so as to have nonslip properties.

According to a further advantageous embodiment, the cover element can be provided with at least one suitable coating or layer that is for, example, comprised of rubber, unvulcanized rubber etc. Advantageously, the corresponding coating or layer is provided with a tread pattern similar to that of the sole of a shoe. With a surface of the cover element embodied as described, traction on the ground and thus safety with regard to walking is increased and, at the same time, a further joint-protecting damping action is provided. Similar to the sole of a shoe the coating, according to another advantageous embodiment of the invention, is exchangeable or replaceable so that, especially when the coating shows wear it can be renewed. In a further advantageous embodiment the cover element within the ground contact surface area is provided with at least one non-slip insert, a so-called pad, preferably comprised of rubber etc. Advantageously, this insert is also exchangeable or replaceable so that renewing of the insert when worn is possible as well as an adaptation and adjustment of the insert to different ground surfaces. The insert can advantageously be pressed or glued to the cover element and can be comprised of a specialty plastic material. Thus, a two-component ground contact surface is provided which allows safe moving on wet, smooth, and polished surfaces.

In another advantageous embodiment of the invention the covering device, for securing the cover element, can be clamped with the aid of the fastening element preferably to the rollers, the roller securing element, the roller bearings or the boot itself. Of course, the cover element can be fastened with the fastening element in any other suitable manner to the roller skate (inline skate). For example, the fastening element can be screwed, snapped on, or otherwise attached to respective receiving elements at the roller skate.

According to a further advantageous embodiment of invention, the fastening element is a clamping bar which is preferably clamped onto the rollers. In a very advantageous embodiment the clamping bar is an open hollow bar that preferably has a is C-shaped or U-shaped cross-section. Advantageously, the fastening element is provided with opposed sidewalls spaced apart and extending parallel to the direction of travel of the rollers. They converge upwardly toward one another so that a clamping of the fastening element is possible.

According to a further suggestion of the invention, the fastening element is embodied such that it can be fastened in variable ways. Thus, the covering device can be positioned at different types of roller skates and is especially also suitable for roller skates having different roller spacings, for example, it can be used for roller skates for children and special roller skates having wider roller spacing.

According to a further embodiment of the invention, the covering device receives the rollers of the roller skates substantially in a positive-locking manner. This improves securing of the covering device at the roller skate and also protects the rollers of the roller skate from damage, for example, damage to the roller bearings by exposure to sand, water etc. . . . According to another advantageous embodiment of the invention, the fastening element and the cover element are of a unitary (one-piece) construction. Thus, the covering device can be manufactured in a simple and economic manner, especially because mounting steps are obsolete. In addition, the unitary construction of the cover element and the fastening element provides for a substantially greater stability and service life of the inventive covering device.

According to another advantageous embodiment of the invention, the covering device has a strap as a fastening element. Advantageously, the strap is elastic, for example, comprised of rubber etc. so that a simple and fast attachment of the covering device is provided. In an especially advantageous embodiment of the invention the strap has two ends. In order to facilitate fastening even further, the covering device can be simply tied on. Preferably, the strap is provided with a VELCRO closure.

In an especially advantageous embodiment the covering device has an opening for guiding the strap therethrough.

The opening extends preferably transverse (perpendicular) to the travel direction of the rollers. According to an advantageous suggestion, the opening is provided in an area under the rollers. The opening is advantageously a through opening, i.e., a substantially slot-shaped opening. The opening according to another advantageous embodiment of the invention is centrally arranged at the covering device. With such an embodiment the covering device can be quickly and easily attached (secured) at the roller skate or inline skate so that even when walking on difficult terrain the covering device remains fixed in position and ensures safe attachment. At the same time, the strap is protected because is does not contact the ground surface and can thus not be damaged.

According to another advantageous embodiment of the invention, the covering device is of an elastic embodiment. This provides for an improvement of impact-damping properties so that walking with the inventive covering device on roller skates is further facilitated and more comfortable. The covering device is advantageously manufactured of a light weight elastic (resilient) material, preferably of plastic material. According to a further advantageous suggestion of the invention, the covering device comprises at least one elastically embodied, shape-stabilizing insert. This insert, for example, can be manufactured in an advantageous manner of spring steel. This ensures that the impact-damping and resilient action of the covering device as well as a safe clamping can be ensured over extended and intensive operating periods.

According to another especially advantageous embodiment of the invention, the covering device at its inner sides is provided with positioning and fixation elements. They serve to align the covering device during positioning and aid at the same time in attaching it.

The positioning and fixation elements are advantageously embodied as pairs of opposed ribs which preferably are of different length and are thus adapted to the roller contour, while at the same time a directed stiffening of the cover element is provided.

According to a further advantageous embodiment the covering device can be retrofitted onto roller skates so that any type of roller skates can be provided with the inventive covering device because of the variable design of the inventive covering device.

According to another advantageous embodiment of the invention the covering device is pivotably connected to the roller skate. This makes it possible to activate the covering device with a simple pivot movement, respectively, unfolding, folding over, rotation etc. so that the covering element will prevent the direct contact between the rollers and the ground surface. A corresponding covering device can, for example, be fastened at the rearward end of the boot, for example, at the securing element, while its other end, when not in use, can be detachably secured, for example, at the boot of the roller skate. When needed, the covering device is detached from the boot of the roller skate and positioned with a simple pivot movement under the rollers of the roller skate in the inventive manner. The inventive contact surface can be, for example, embodied such that it is formed during positioning or can be provided with a permanent desired curvature. Such a design also has the advantage that the covering device can not be lost and is always present at the roller skate. According to a further advantageous embodiment the inventive covering device is embodied as a part of the roller skate so that it is specially designed for the particular roller skate.

According to a further advantageous suggestion of the invention, the inventive covering device is connectable laterally between the rollers of the corresponding roller skate. Further advantageous embodiments of the invention, which prevent substantially upon activation a movement of the rollers, are possible. For example, a corresponding snap-on bar with preformed pins can be used for engaging respective recesses at the rollers so that they are prevented from movement, i.e., rotation.

BRIEF DESCRIPTION OF THE DRAWINGS

The object and advantages of the present invention will appear more clearly from the following specification in conjunction with the accompanying drawings, in which:

FIG. 12 shows a plan view of a further embodiment of the inventive covering device;

FIG. 13 shows a sectional view of the covering device according to FIG. 12;

FIG. 14 shows a further sectional view of the covering device according to FIG. 12;

DESCRIPTION OF PREFERRED EMBODIMENTS

The present invention will now be described in detail with the aid of several specific embodiments utilizing FIGS. 1–25.

Figure 1:
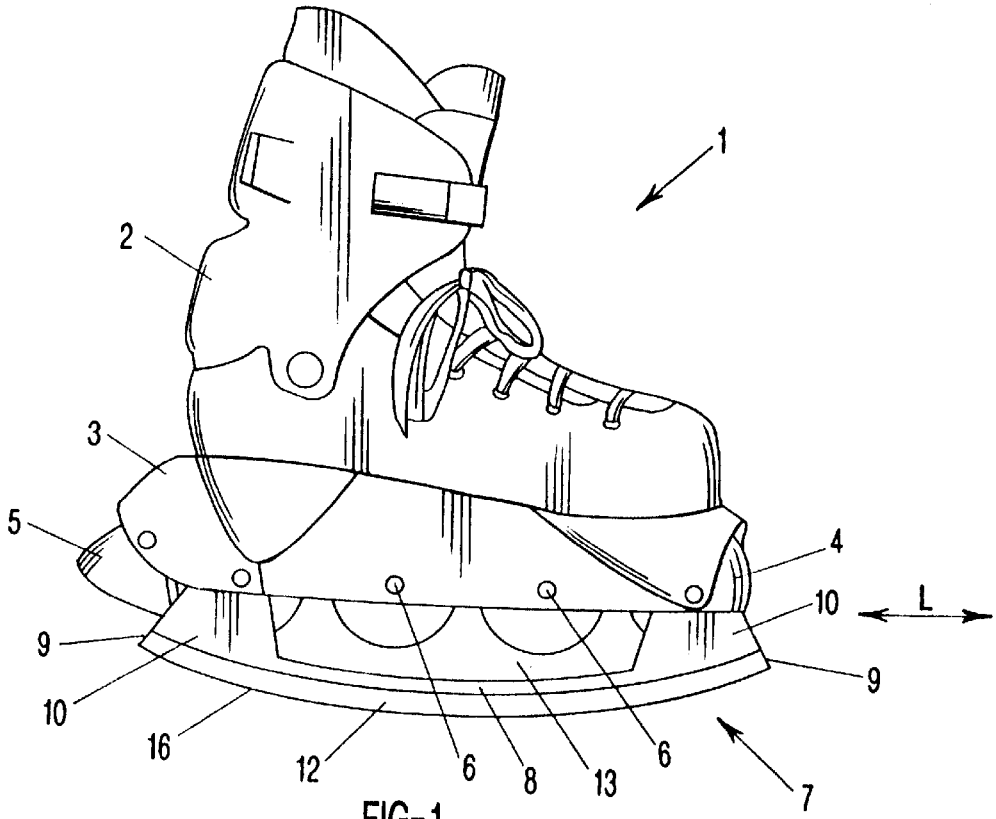
FIGS. 1 and 2 show an embodiment of the inventive covering device connected to an inline skate.
Figure 2:
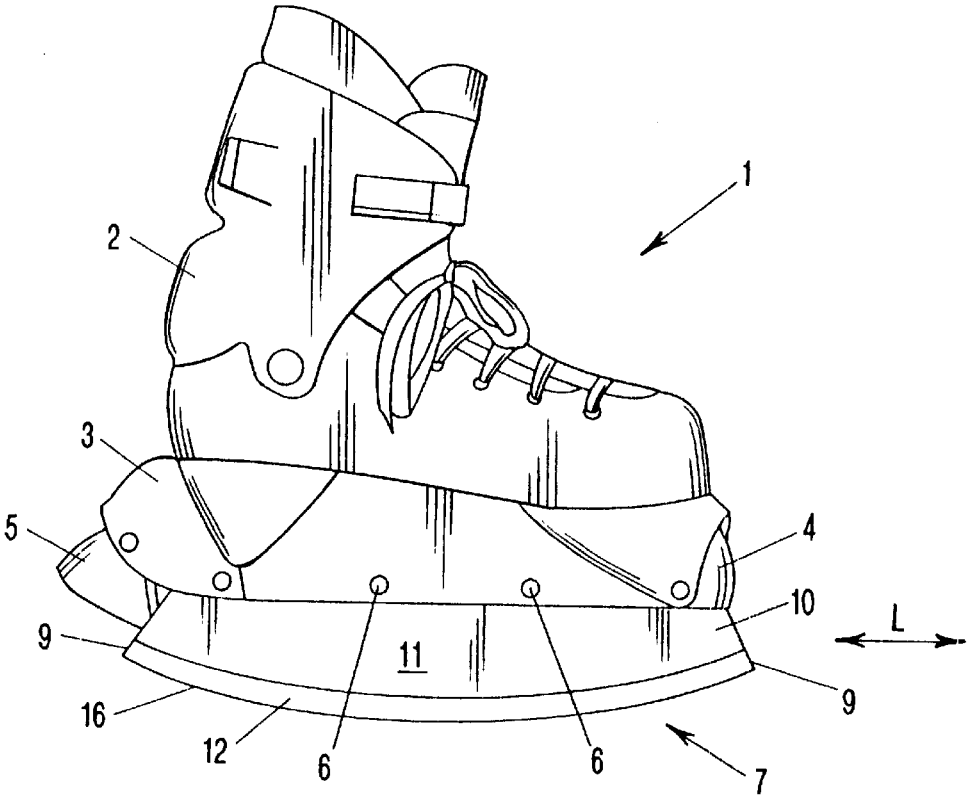

The embodiment represent in FIGS. 1 and 2 show respectively a known roller skate 1, comprised of a boot 2 with a securing element 3 fixedly connected to the sole of the boot 2. The securing element 3 serves to receive and support the rollers 4. The brake 5 is positioned within the heel area of the boot. For supporting the rollers 4 and the brake 5, the securing element 3 is provided within the lower area with corresponding bearings, respectively, bearing axles 6.

As shown in FIGS. 1 and 2, the area of the roller skate 1 positioned below the rollers 4 is provided in each embodiment with the inventive covering device 7 extending in the direction of travel L of the rollers 4. The covering device 7 represented in FIG. 1 is in the form of a rail-shaped cover element 8 extending relative to the ground in a substantially arc-shaped embodiment and providing a ground contact surface 16 that allows for an ergonomic foot movement (rolling of the foot). The cover element 8 is provided at the respective ends 9 with a fastening element 10. The fastening element 10 is in the form of a clamping bar which clamps onto the forward, respectively, rearward roller 4. As shown especially in the sectional view of FIG. 3 of the inventive covering device 7, the covering device 7, comprised by the fastening element 10 and the covering element 8, is embodied as a unitary part. It can further be taken from FIG. 3 that the covering device 7, especially in the area of the fastening element 10, has a substantially U-shaped cross-section. The lateral sidewalls 11 are slightly slanted so that, upon attachment of the covering device 7 in the area of the rollers 4 of the roller skate 1, they will laterally clamp onto the rollers 4. The embodiment of FIG. 2 shows a covering device 7 with fastening element 10 that is clamped onto all rollers 4 of the roller skate 1. The covering device 7 is comprised of a plastic material or any other suitable slightly elastic, resilient material in order to allow a clamping action. It can additionally be provided with the shown inserts. Also, it is possible to design the covering device 7 such that it is clampable onto the securing element 3, respectively, is secured thereat in any suitable manner.

Figure 3:
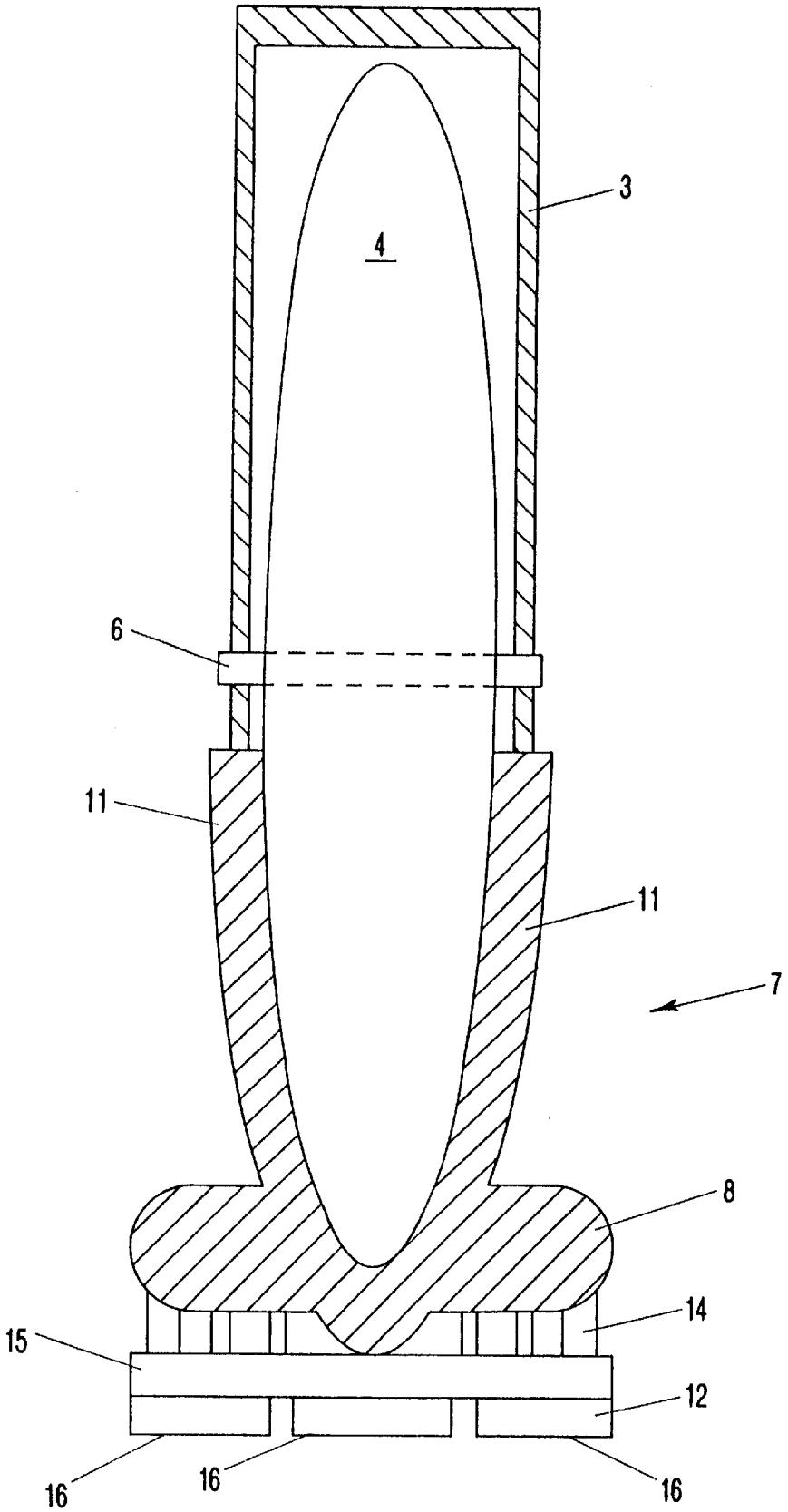
FIG. 3 shows a partly sectional view of the covering device connected to an inline skate.

As shown in FIGS. 1–3, the cover element 8 is provided with a coating or layer 12 applied to the ground contact surface 16 facing the ground. The coating 12 is comprised of a non-slip material such as rubber in order to prevent slipping when walking and to ensure safe standing on the roller skates. The coating 12 can be, for example, a wear-resistant rubber material in order to allow walking especially on smooth surfaces, for example, wood floors, marble etc. whereby the material is selected to be non-marring, i.e., no rubber marks will be left on the surface. Furthermore, the embodiment represented in FIG. 3 is provided with stays 14 positioned between the cover element 8 and the coating 12. These stays 14 are embodied similar to a spring or a damping element so that when walking the foot joint is relieved and thus protected against fatigue. The stays 14 can be embodied directly with the cover element 8, or as is shown in FIG. 3, can be subsequently attached to the cover element 8, for example, by screwing, snap-on connections, or by using an adhesive. In addition, as shown in FIG. 3, the coating 12 is exchangeable or replaceable (renewable) similar to the sole of a shoe. In the embodiment represented in FIG. 3, a fastener 15 is provided between the dampening stays 14 and the coating 12. For example, the coating 12 is attached to the fasteners 15 by gluing or screwing in order to allow replacement of the coating 12 similar to the sole of a shoe when the coating 12 is worn. The fastener 15 can also be a unitary part of the cover element 8, respectively, the stays 14 or can be fastened thereto for example, with a screw connection, snap-on connection, or adhesive connection. Furthermore, it is possible to embody the fastener 15 with stays 14 and the cover element 8 in the form of a double rail.

Due to the curved embodiment of the ground contact surface 16 of the cover element 8, the rolling of the foot from heel to toe is facilitated and an ergonomic foot movement is possible during walking. In the embodiment represented in FIG. 1 a further spring action, damping action etc. is provided by the resilient area 13 between the two fastening elements 10 in order to provide for a further improved, simple and joint-protecting walking action.

Figure 4:
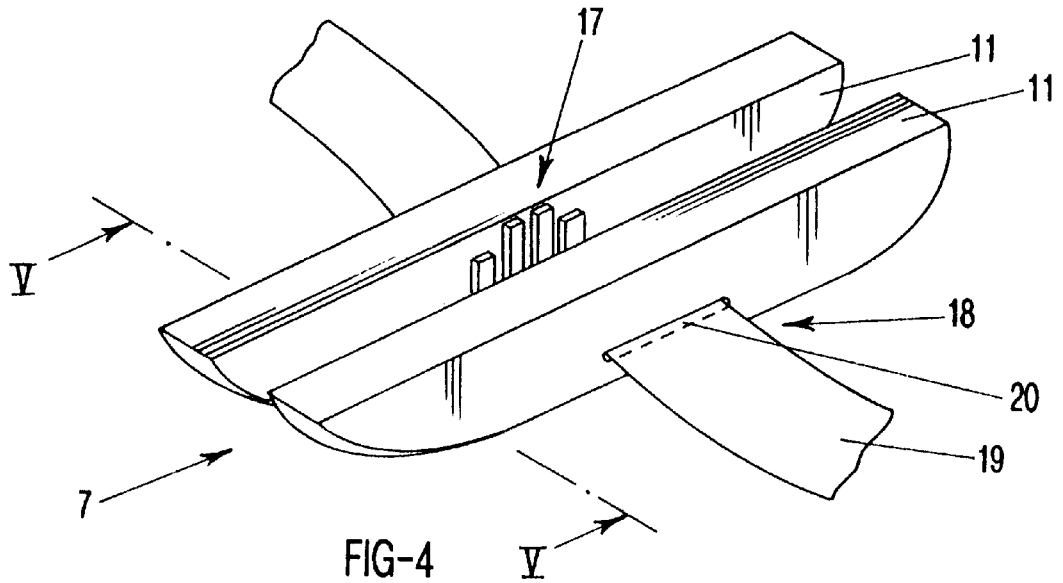
FIG. 4 shows a perspective view of a further embodiment of the inventive covering device.

FIG. 4 shows in a perspective view a further embodiment of the inventive covering device 7. In this covering device 7 the ground contact surface 16, provided at the cover element 8, and the fastening element 10 in the form of a clamping bar are of a unitary construction with a substantially U-shaped cross-section. The fastening element 10 thus is provided with sidewalls 11 extending at a spacing to one another and substantially parallel to one another in the travel direction L of the rollers. In the upward direction they converge so as to provide for a conical upward design to allow, when attached, a clamping of the fastening element 10, as is shown especially with the aid of the sectional view of FIG. 5. As shown in FIG. 4, the covering device at the inner side is provided with different paired positioning and fixation elements 17 which aid in aligning of the covering device 7 below the roller skates 1 and at the same time provide for a fixation of the rollers 4. Furthermore, the positioning and fixation elements 17 causes a substantial stiffening of the covering device 7. The covering device 7 according to FIGS. 4 and 5 comprises a further centrally arranged fastening element 18 in the form of a strap 19. The strap 19 extends through an opening 20 which in the area of the covering element 8 extends transverse to the travel direction L of the roller 4. The strap 19 is used as an additional fastening means of the covering device 7. The strap 19 is placed over the boot (not represented in FIGS. 4 and 5) and is then substantially positive-lockingly attached.

Figure 5:
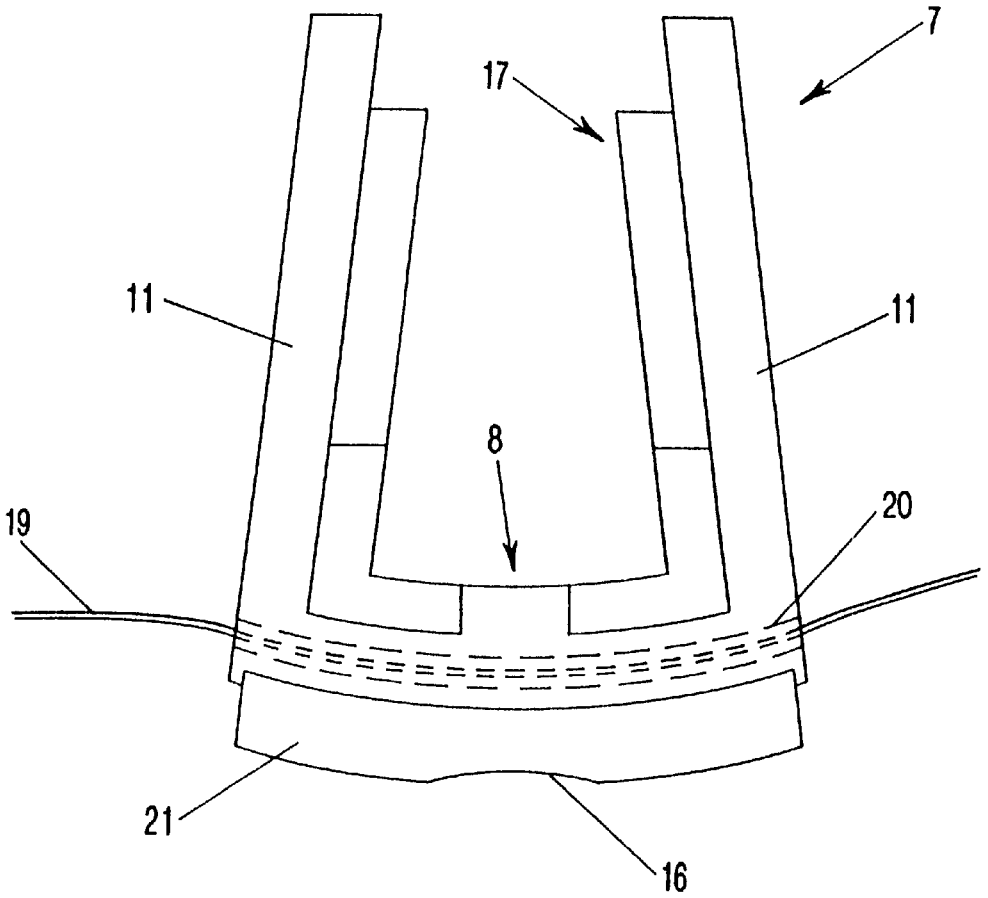
FIG. 5 shows a sectional view of the covering device according to FIG. 4.

The covering device 7 shown in FIGS. 4 and 5 is provided with non-slip inserts 21 which are exchangeable so that they can be replaced when they are worn.

Figure 6:
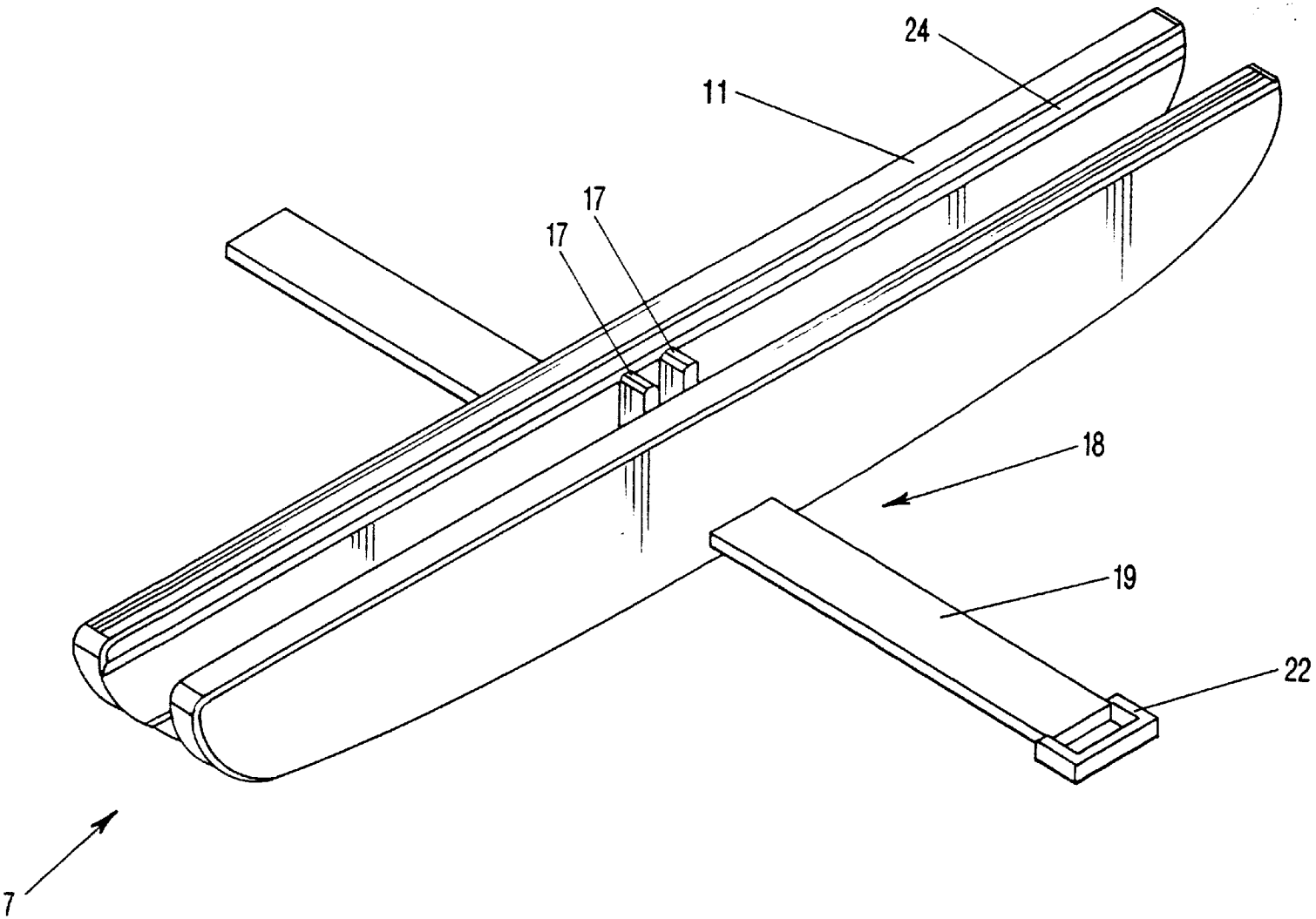
FIG. 6 shows a perspective view of a further embodiment of the inventive device.

FIG. 6 shows a perspective view of a further embodiment of the inventive covering device 7. As in the covering device 7 represented in FIG. 4, the covering device 7 of FIG. 6 is also provided with centrally arranged positioning and fixation elements 17 at the center of the covering device 7. As an additional fastening element 18 a strap 19 is provided which for securing has a buckle 22.

Figure 7:
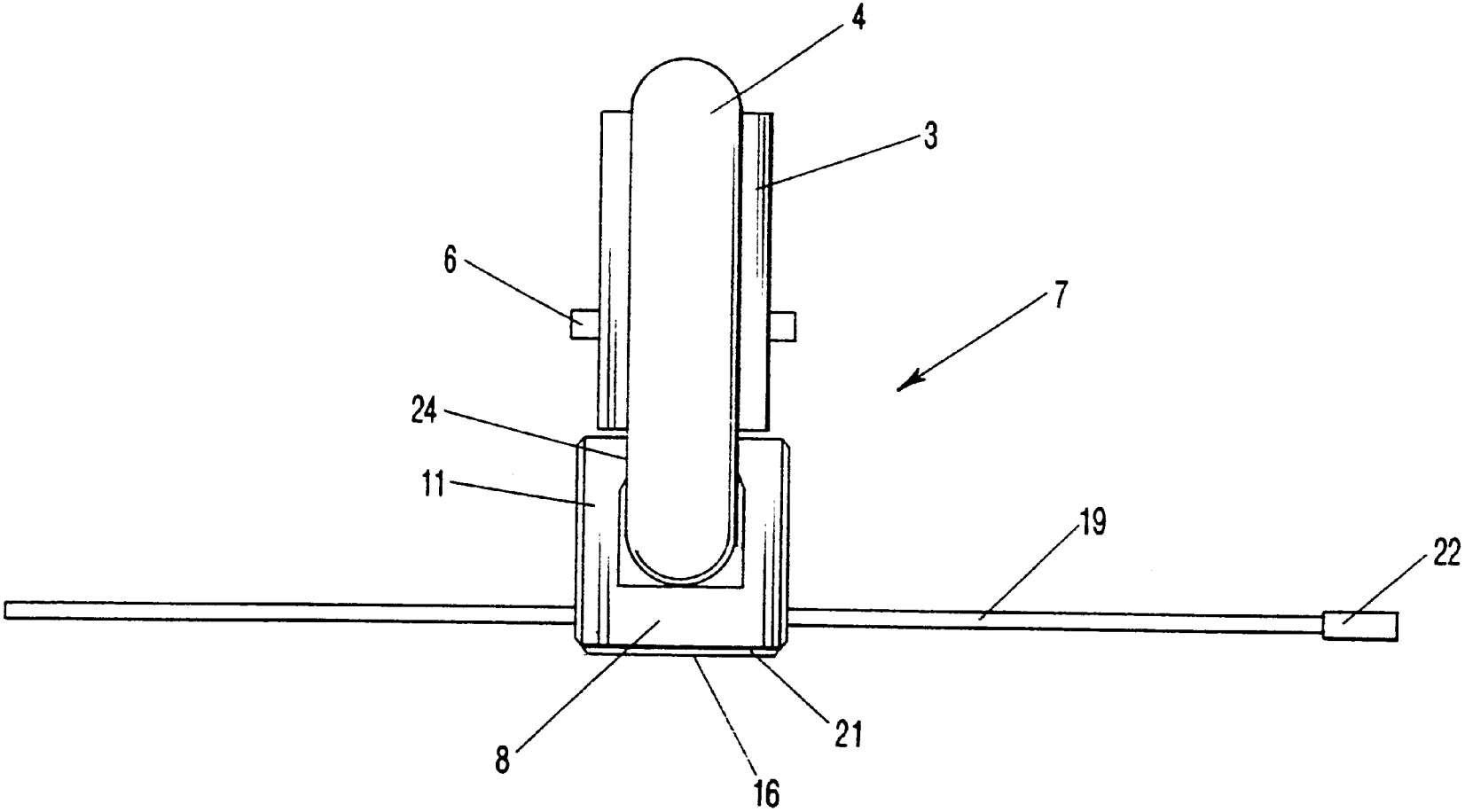
FIG. 7 shows a front view of the covering device of FIG. 6.

FIG. 7 shows a covering device 7 according to FIG. 6 in a front view. The covering device 7 is attached by clamping to the schematically represented rollers 4 of a non-represented roller skate 1 below the securing device 3. As shown in FIGS. 6 and 7, the sidewalls 11 of the covering device 7 are provided with projections 24 which project into the interior of the space delimited by the covering device 7. In the shown embodiment, the projections 24 together with the sidewalls 11 and the substantially U-shaped cross-section of the hollow profile of the covering device 7 thus provide a plier-like clamping action for securing onto the rollers 4.

Figure 8:
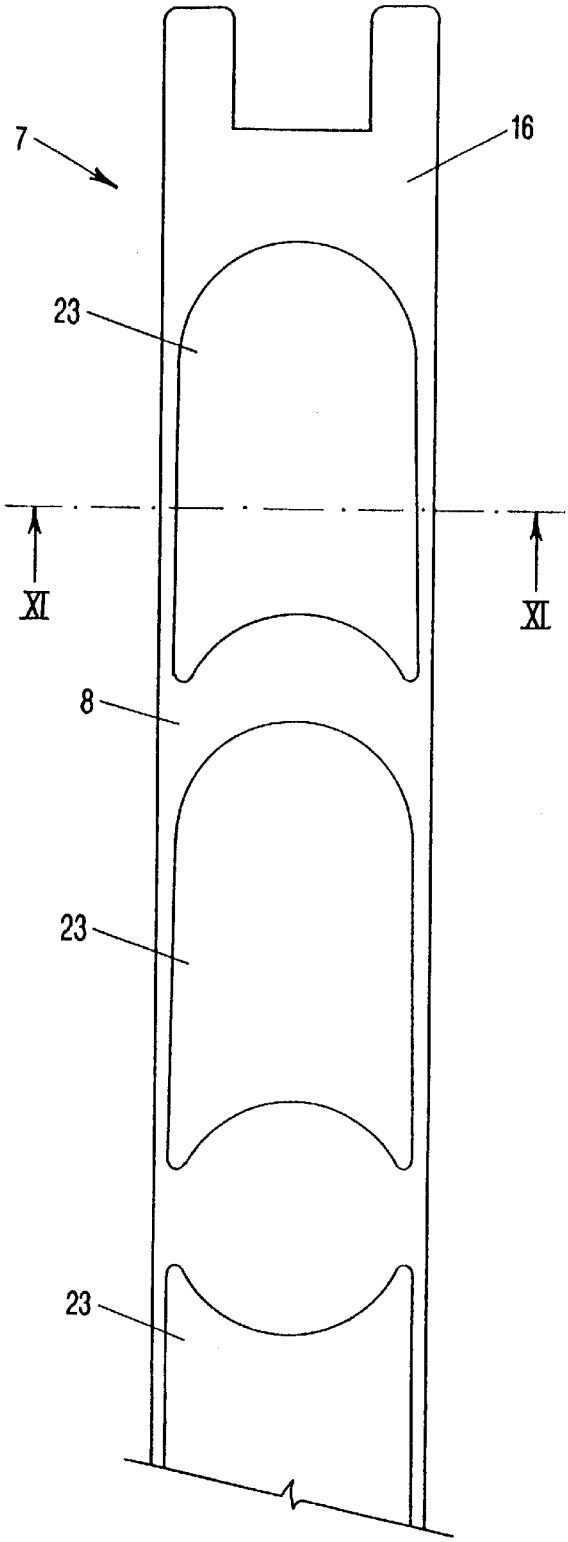
FIG. 8 shows a bottom view of a partly represented covering device.
Figure 9:
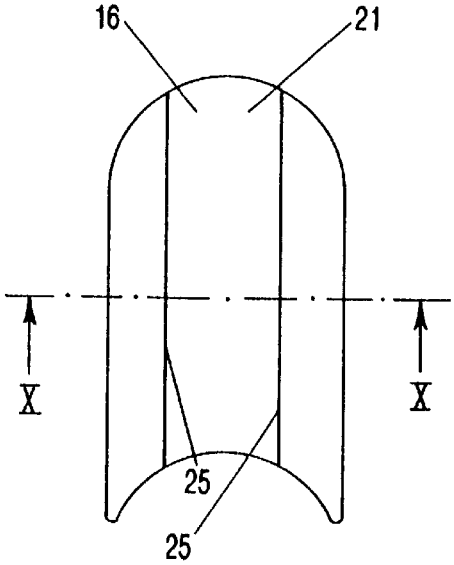
FIG. 9 shows a view from below onto an insert for a covering device according to FIG. 8.
Figure 10:
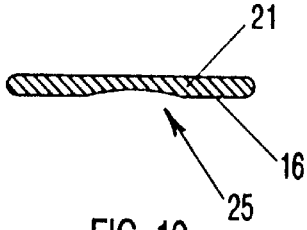
FIG. 10 shows a sectional view of the insert according to FIG. 9.
Figure 11:
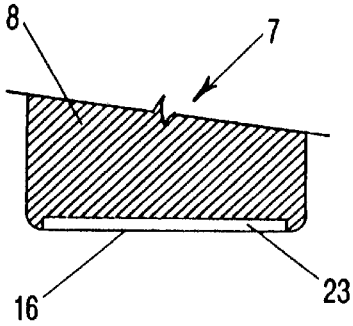
FIG. 11 shows a sectional view of a portion of a covering device according to FIG. 8.

FIG. 8 shows in a view from below a portion of the covering device 7. Within the cover element 8 of the covering device 7, at the ground support surface 16, recesses 23 are provided as can be especially seen in the sectional view of FIG. 11. Into these recesses 23 the inserts 21 made of a non-slip material such as rubber or a similar material represented in FIGS. 9 and 10 are insertable. For example, they can be attached by gluing or pressing. As represented in FIGS. 9 and 10, the insert 21 is provided at its face providing part of the ground support surface 16 with a tread pattern 25 which increases the non-slip properties of the ground support surface 16.

FIG. 12 shows in plan view a further embodiment of the covering device 7 which at its inner side is provided with centrally arranged positioning and fixation elements 17. As can be seen in FIG. 13, the positioning and/or fixation elements 17 are in the shape of ribs of different lengths.

As can be seen in FIG. 13 and in the sectional view of FIG. 14, the covering device 7 is provided with an opening 20 below the positioning and/or fixation elements 17 through which a non-represented strap (19) is guided as an additional fastening element 18.

Figure 15:
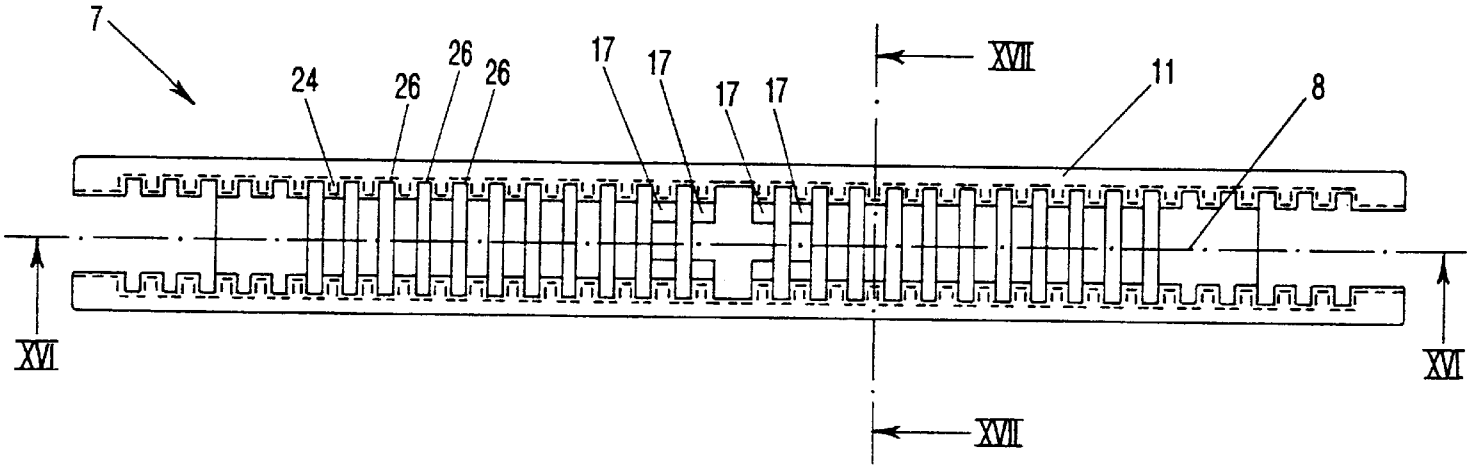
FIG. 15 shows a plan view of a further embodiment of the inventive covering device.
Figure 16:
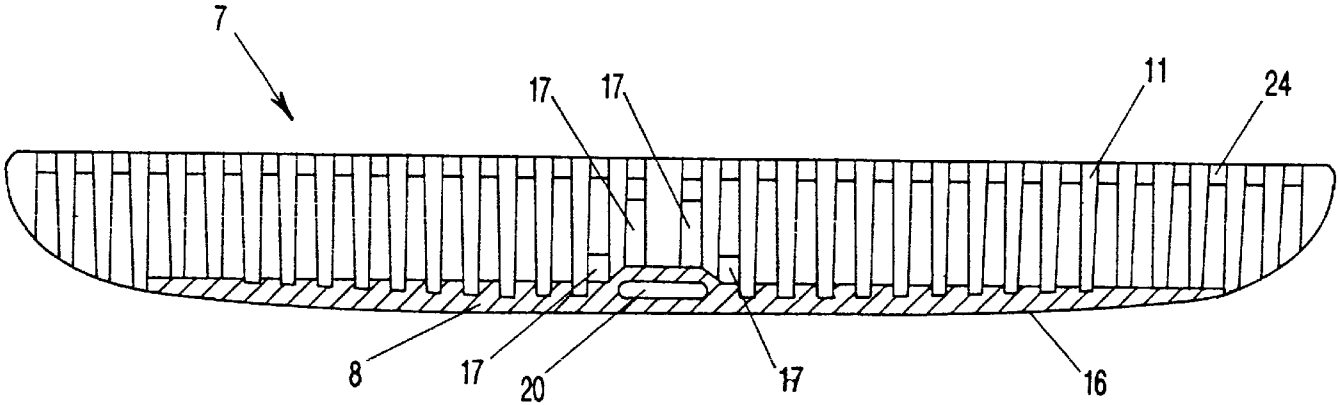
FIG. 16 shows a sectional view of the covering device according to FIG. 15.
Figure 17:
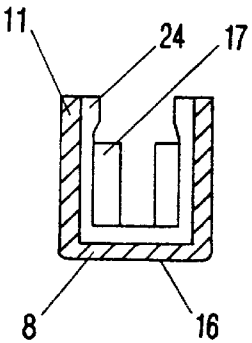
FIG. 17 shows a further sectional view of the covering device according FIG. 15.

FIGS. 15–17 shows a further embodiment of a covering device 7. The sidewalls 11 and the cover element 8 of the covering device 7 are provided at their inner sides with lamella-shaped recesses 26 which increase, on the one hand, the stability and flexibility of the covering device 7 and, on the other hand, reduce its weight.

Furthermore, the covering device 7 due to the lamella-shaped recesses can be clamped in a more efficient manner to the parts of the roller skate to which it is to be connected, for example, the rollers.

Figure 18:
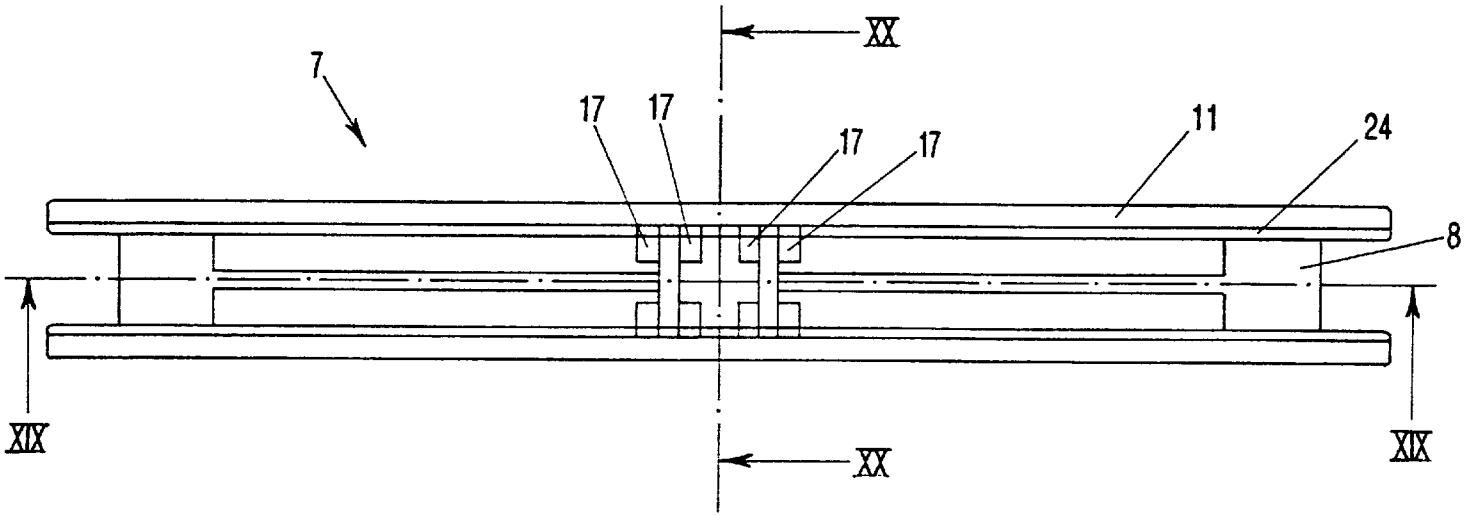
FIG. 18 shows a plan view of a further embodiment of the inventive covering device.
Figure 20:
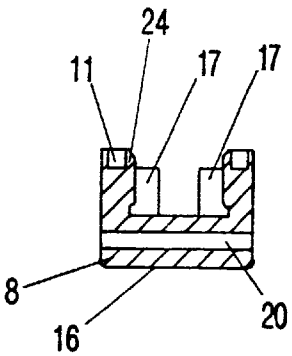
FIG. 20 shows a further sectional view of the covering device according to FIG. 18.
Figure 19:
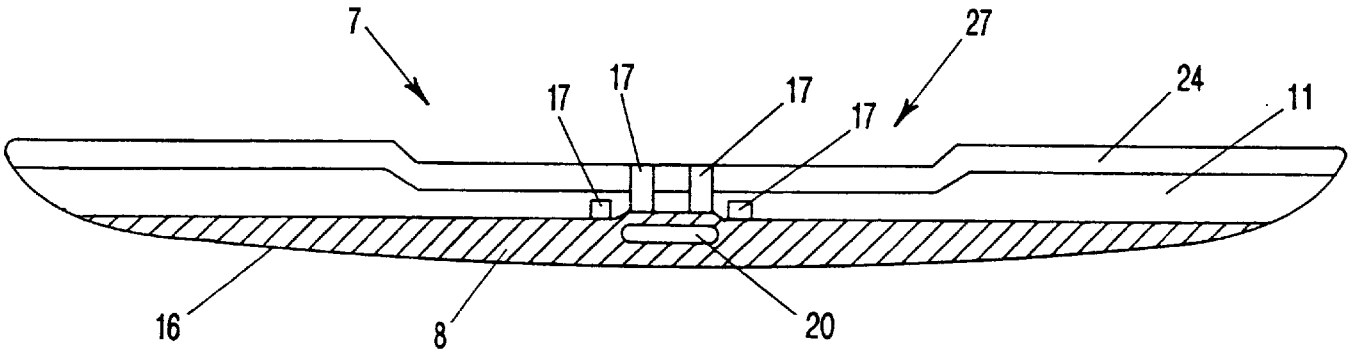
FIG. 19 shows a sectional view of the covering device according FIG. 18.

FIGS. 18–20 show a further embodiment of a covering device 7. As can be seen especially in the sectional view of FIG. 19, it has, in the central area of the sidewalls 11, recesses 27 extending in the travel direction L. This covering device 7 is especially suitable for roller skates with a sliding area positioned between the two central rollers and designed, for example, for sliding on handrails.

Figure 21:
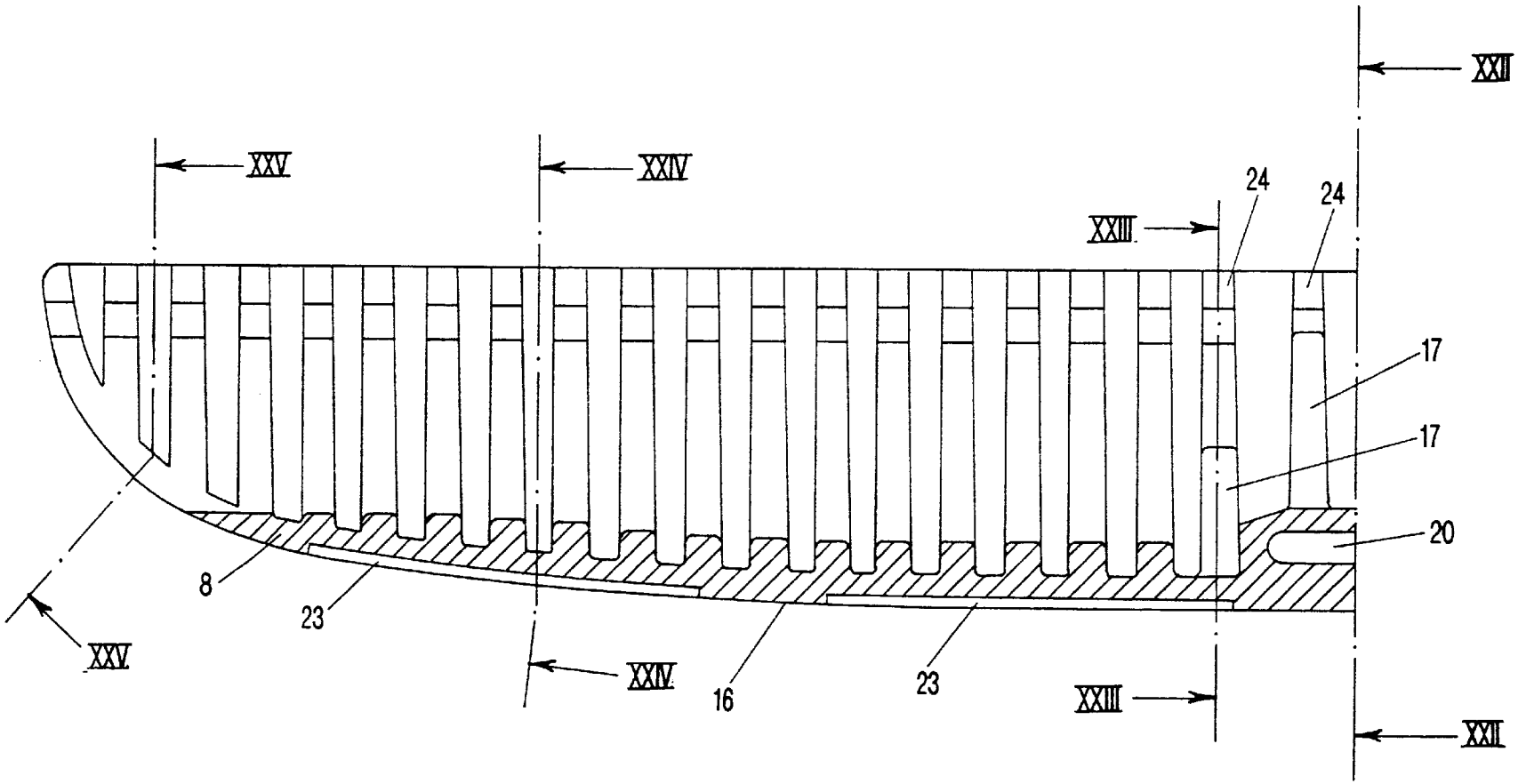
FIG. 21 shows a sectional view of a further embodiment of the inventive covering device similar to FIGS. 15–17.

FIG. 21 shows in a sectional view a portion of the covering device 7 according to FIGS. 15–17.

Figure 22:
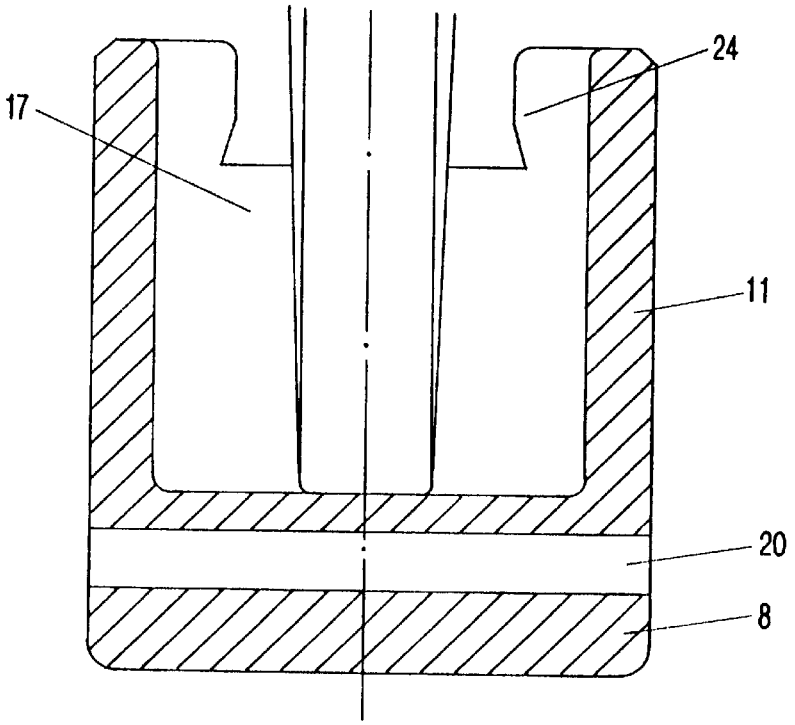
FIG. 22 shows a sectional view of the covering device according to FIG. 21.
Figure 23:
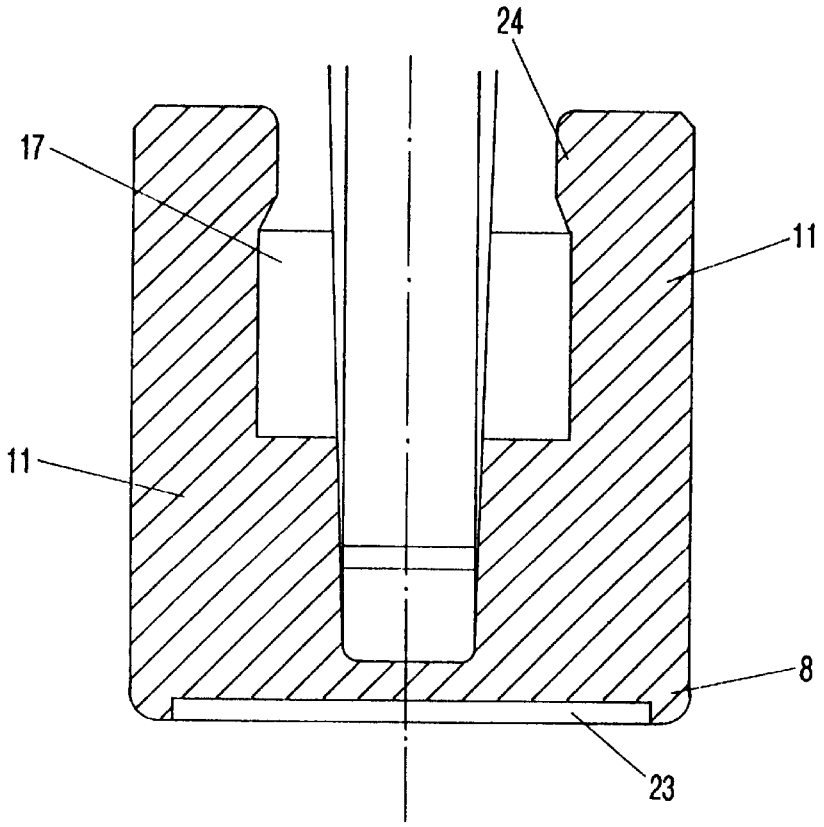
FIG. 23 shows a sectional view of the covering device according to FIG. 21.
Figure 24:
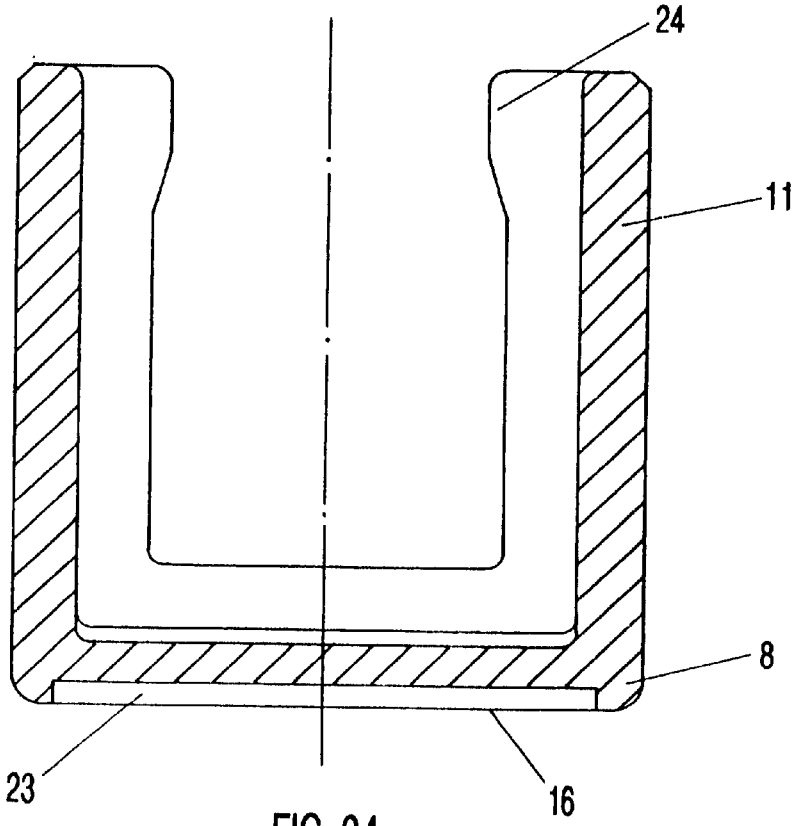
FIG. 24 shows a sectional view of the covering device according to FIG. 21.
Figure 25:
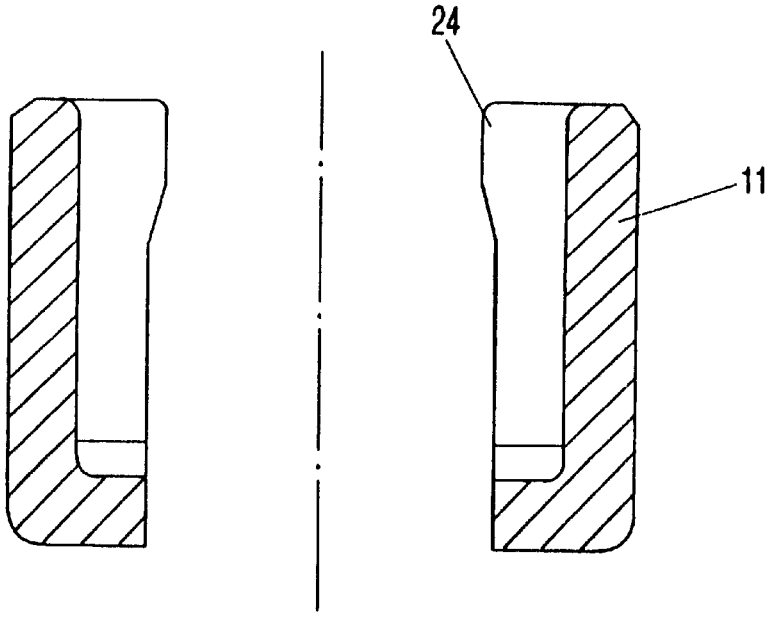
FIG. 25 shows a sectional view of the covering device according to FIG. 21.

FIGS. 22–25 show different sectional views according to the section lines shown in FIG. 21. As illustrated in FIG. 22 and FIG. 23 by auxiliary lines, the opposed positioning and/or fixation elements 17 widen conically toward the opening of the hollow profile. Thus, the positioning and/or fixation elements 17 provide a double function. On the one hand, they serve as a central positioning guide for the covering device 7 below the roller skate 1. On the other hand, due to their conical embodiment they clamp onto the rollers 4 of the roller skate 1 so that the securing action of the covering device 7 is enhanced. As represented in FIG. 22, the covering device 7 in the area below the positioning and/or fixation element 17 has an opening 20 for guiding therethrough the non-represented strap (19) as an additional fastening element 18.

The distance between the opposed positioning and/or fixation elements 17 is advantageously such that it matches the width of a sidewall 11 with projection 24 of the covering device 7. Thus, two covering devices 7, can be inserted into one another for example, for transporting. Due to the conical extension of the positioning and/or fixation elements 17 the two covering devices are thus securely clamped to one another.

The present invention is, of course, in no way restricted to the specific disclosure of the specifications, and drawings, but also encompasses any modifications within the scope of the appended claims.

What I claim is:

1. A covering device for rollers of roller skates, said covering device comprising:

a cover element for positioning underneath rollers of a roller skate;

a fastening element connected to said cover element for fastening said cover element to the roller skate;

said cover element comprising a ground contact surface extending, when said covering device is attached to the roller skate, in a direction of travel of rollers of the roller skate and having an arc shape in said direction of travel to allow an ergonomic foot movement of a user;

said cover element having inner sides facing one another;

said fastening element comprising positioning and fixation elements connected to said inner sides centrally relative to a longitudinal extension of said cover element, wherein said positioning and fixation elements clamp said cover element to the rollers.

2. A covering device according to claim 1, wherein said arc shape is adjustable.

3. A covering device according to claim 1, wherein said cover element is elastically deformable.

4. A covering device according to claim 1, wherein said cover element is rail-shaped.

5. A covering device according to claim 1, wherein said ground contact surface has at least partly non-slip properties.

6. A covering device according to claim 5, wherein at least portions of said ground contact surface have a coating.

7. A covering device according to claim 6, wherein said coating is exchangeable.

8. A covering device according to claim 5, wherein said cover element has a tread pattern.

9. A covering device according to claim 5, wherein said cover element is rubberized.

10. A covering device according to claim 1, wherein two of said covering devices are connectable.

11. A covering device according to claim 1, wherein said fastening element clamps onto the rollers.

12. A covering device according to claim 11, wherein the roller skate has a securing element for the rollers and wherein said fastening element clamps onto the securing element.

13. A covering device according to claim 1, wherein the roller skate comprises a boot and wherein said fastening element clamps onto the boot.

14. A covering device according to claim 1, wherein said fastening element is a clamping bar.

15. A covering device according to claim 14, wherein said clamping bar is a hollow bar.

16. A covering device according to claim 15, wherein said hollow bar has a C-shaped cross-section or a U-shaped cross-section.

17. A covering device according to claim 1, wherein said fastening element has spaced apart, opposed sidewalls extending parallel to said direction of travel and converging in an upward direction toward one another to allow a clamping action between said opposed sidewalls.

18. A covering device according to claim 1, wherein said fastening element is variably fastenable.

19. A covering device according to claim 1, wherein the rollers are positive-lockingly received in said covering device.

20. A covering device according to claim 1, wherein said cover element and said fastening element form a unitary part.

21. A covering device according to claim 1, wherein said covering device is elastic.

22. A covering device according to claim 21, wherein said covering device is comprised of an elastic, resilient material.

23. A covering device according to claim 1, wherein said covering device is comprised of plastic material.

24. A covering device according to claim 1, further comprising at least one elastic, shape-stabilizing insert.

25. A covering device according to claim 24, wherein said insert is comprised of spring steel.

26. A covering device according to claim 1, wherein said covering device is retrofitted to the roller skate.

27. A covering device according to claim 1, wherein said covering device is embodied as a part of the roller skate.

28. A covering device according to claim 1, comprising an additional fastening element that is a strap.

29. A covering device according to claim 28, wherein said strap is elastic.

30. A covering device according to claim 28, wherein said strap has a first and a second end.

31. A covering device according to claim 28, wherein said strap has a hook and loop fastener.

32. A covering device according to claim 28, wherein said cover element comprises an opening and wherein said strap extends through said opening.

33. A covering device according to claim 1, further comprising at least one non-slip insert.

34. A covering device according to claim 28, wherein said strap is located centrally at said covering device below said positioning and fixation elements.

35. A covering device according to claim 33, wherein said at least one non-slip insert is exchangeable.

* * * * *